United States Patent [19]

Mützell

[11] Patent Number: 4,853,988

[45] Date of Patent: Aug. 8, 1989

[54] OVERWATER PRESSURE JET MASSAGE APPARATUS

[76] Inventor: Theodor Mützell, 7 Senator Street, Hobart, Australia

[21] Appl. No.: 159,097

[22] Filed: Feb. 23, 1988

Related U.S. Application Data

[63] Continuation-in-part of Ser. No. 556,708, filed as PCT AU82/00164 on Oct. 7, 1982, published as W083/01896 on Jun. 9, 1983, Pat No. 4.757,562.

[30] Foreign Application Priority Data

Dec. 3, 1981 [DE] Fed. Rep. of Germany ..... 3147798

[51] Int. Cl.[4] ..... A61H 23/04

[52] U.S. Cl. ..... 4/615; 4/621; 128/64; 128/65; 128/66

[58] Field of Search ..... 4/443, 446, 541, 542, 4/543, 596, 615, 621; 128/38, 39, 64, 65, 66, DIG. 20

[56] References Cited

FOREIGN PATENT DOCUMENTS 83101896 6/1983 Austria .

OTHER PUBLICATIONS

Buderus, Oct. '87.
der deutsche badebetrieb, Nov. 11, 1982.
Int. J. Rehab. Research, 1982 5 (4) 545–548.
"Water Jet at Heart of Massage Machine", Jun. 29, 1984, Engineers Australia.
Extract from the newspaper "Enterprise", vol. 2, No. 5, published Mar. 1984.
Extract from newspaper "Enterprise", vol. 2, No. 5, titled "Big Advance in Massage", published Mar. 1984 by The Tasmanian Development Auth.
Letter from Kenneth J. Box published Oct. 18, 1984 by "The University of Tasmania".
Letter from Susanne Atkins published Oct. 24, 1984 by "The University of Tasmania".
Extract from newspaper "Enterprise", vol. 2, No. 5, published Mar. 1984.
Engineers Australia, Jun. 29, 1984, 27.
Int. J. Rehab. Research, 1982, 5 (4).

*Primary Examiner*—Henry J. Recla
*Assistant Examiner*—Robert M. Fetsuga
*Attorney, Agent, or Firm*—Herbert Dubno

[57] ABSTRACT

A massage using a water jet without contact of the body of the subject with the water is effected by positioning the subject on an openwork support covered by a water impermeable flexible layer. An indicator above the patient displacing the location at which the massage is occurring and is coupled to the nozzle directing an upward jet against the layer from below. The operator can control the position of the nozzle in accordance with the indication.

7 Claims, 5 Drawing Sheets

OVERWATER PRESSURE JET MASSAGE APPARATUS

CROSS REFERENCE TO RELATED APPLICATION

This application is a continuation-in-part of my copending Ser. No. 06/556,708 filed Nov. 28, 1983 (now Pat. No. 4,757,562) which was a national phase application corresponding to PCT/AU82/00164 filed Oct. 7, 1982 and based, in turn, upon a German National application No. P 31 47 798.4 of Dec. 3, 1981.

FIELD OF THE INVENTION

My present invention relates to an overwater pressure jet massage apparatus and, more particularly, to a massage apparatus which relieves the masseuse of considerable effort, permits localized massage with great precision and improves the sanitary conditions for water jet massage. The invention also relates to an apparatus for carrying out the improved method.

BACKGROUND OF THE INVENTION

In my copending application identified above, the underlying PCT application and the prior German application, I have described the principles of an overwater jet massage which utilizes a jet of water trained upwardly from at least one nozzle against the underside of a flexible, e.g. elastic, layer overlying an openwork support and upon which the body of the individual or subject to be massaged can rest in repose.

In that device and method, the openwork support was a screen or grid and the layer was a hood which extended downwardly into a vessel or receptacle disposed beneath the layer and in which, in turn, the nozzle could be arranged.

The nozzle was moveable, e.g. in a two-coordinate system, to sweep the jet beneath the body of the individual in a particular pattern.

Where the jet impinged from below upon the layer, the latter was deformed upwardly and at this point, the deformed layer, lifted by the water jet, would engage the body of the subject like a finger in a massaging action.

Since the water was recirculated from the vessel to the nozzle, the process was entirely sanitary and the water could be reused for massaging a number of subjects. The water never touched the body of the subject.

Furthermore, comparatively small amounts of water could be used, the jet permitted a highly effective massage to be effected, and the nature of the massage was not unlike the type of massage which can be obtained by the fingers of a skilled masseuse.

Contamination of the water did not occur and hence disposal of the water posed no problem and, by contrast with conventional water massage, there was no risk of infection to the subject from reuse of the water or from skim contact between patient and masseuse as is required in manual massage.

Masseurs usually cannot wear impermeable gloves as suggested by the U.S. Center for Disease control (*Recommendations for Prevention of HIV Transmission in Health Care Settings,* Mass. Med. Soc. 21 August 1987, 36, No. 2S, Page 65, point 1) for contact with nonintact skin on all patients, because there is excessive production of sweat on skin which cannot breathe during heavy exercise. Excessive perspiration plus rubbing will cause skin lesions.

In the above mentioned earlier application, I refer to German Open Application DE-OS No. 2641469, German Open Application DE-OS No. 2601506 and German Patent DE-PS No. 213041 and, since the advantages of the overwater massage over the massage systems of these references is adequately developed in the earlier application that will not be repeated here but will be assumed to be included by reference.

The massage which can be provided by my earlier apparatus is advantageous to improve body tone and to remove or eliminate pain from neck, vertebral column and other back areas of a patient, to stimulate blood flow and prevent necrosis in the case of a bed ridden patient and in general to improve the wellbeing of a patient.

It has all of the advantages of underwater massage with a minimum of effort on the physiotherapist's part.

OBJECTS OF THE INVENTION

It is the principal object of the present invention to provide an improved method of effecting massage which will extend the principles of my prior applications and permit them to be practiced in a more versatile manner, e.g. utilizing an apparatus which is simpler to handle.

Another object of this invention is to provide an improved apparatus for effecting overwater pressure jet massage utilizing the principles of the earlier applications.

SUMMARY OF THE INVENTION

These objects and others which will become apparent hereinafter are attained, in accordance with the invention, in a massaging method in which the patient or other subject is placed upon a flexible layer on a support, a jet of water is trained upwardly against the underside of the support to deform this layer upwardly and effect a massaging action on the body of the patient. An indicator is provided as to the location on the body at which the massaging action is taking place and is coupled to the nozzle, and the nozzle is moved to cause its jet to massage selected local areas as indicated to the operator by the position denoted by the indicator.

According to a feature of the invention, the indicator includes a light source which can project a support of light on the body opposite the portion of the layer against which the jet is trained.

I can control the temperature of the jet by controlling the temperature of the water in the vessel which is pumped to the nozzle, the vessel being located beneath the layer for collecting water rebounding therefrom.

I can also control the velocity of the jet and/or its kinetic energy and may provide a timer for automatically terminating the duration of the massage after the lapse of a predetermined time interval.

According to the apparatus aspects of the invention, therefore, the nozzle is coupled to the indicator and means is provided for displacing the nozzle below the flexible layer in accordance with the display afforded by the indicator so that the jet effects massage of a selected portion of the body through the layer.

The support for the layer can be a flexible cable grid and the nozzle can be mounted for movement in the vessel or with vessel with at least two degrees of freedom in a coordinate system.

The apparatus also includes pump means connecting the nozzle with the vessel for recirculating water from the vessel to the nozzle, means for controlling the temperature of the water forming the jet and means for controlling the kinetic energy of the jet impinging upon and deforming the layer.

Advantageously, the indicator is located above the layer and is mechanically coupled therewith. Indeed, where the indicator is a light source such as a laser of an energy which is not detrimental to the subject, the light source can be mounted on an arm cantilevered from an upright above the subject.

The upright is connected to a carriage on which the nozzle or a group of nozzles can be supported and, for movement of the light source on the arm, the light source can be connected by a flexible element to the nozzle to displace the light source and the nozzle identically.

The controls can be coupled by wire to the apparatus or the operator may be provided with a wireless control transmitting its signals by radio waves, ultrasonic waves or infrared waves to the controlled part of the apparatus.

BRIEF DESCRIPTION OF THE DRAWINGS

The above objects, features and advantages of my invention will become more readily apparent from the following description, reference being made to the accompanying highly diagrammatic drawing in which.

SPECIFIC DESCRIPTION

Figure 1:
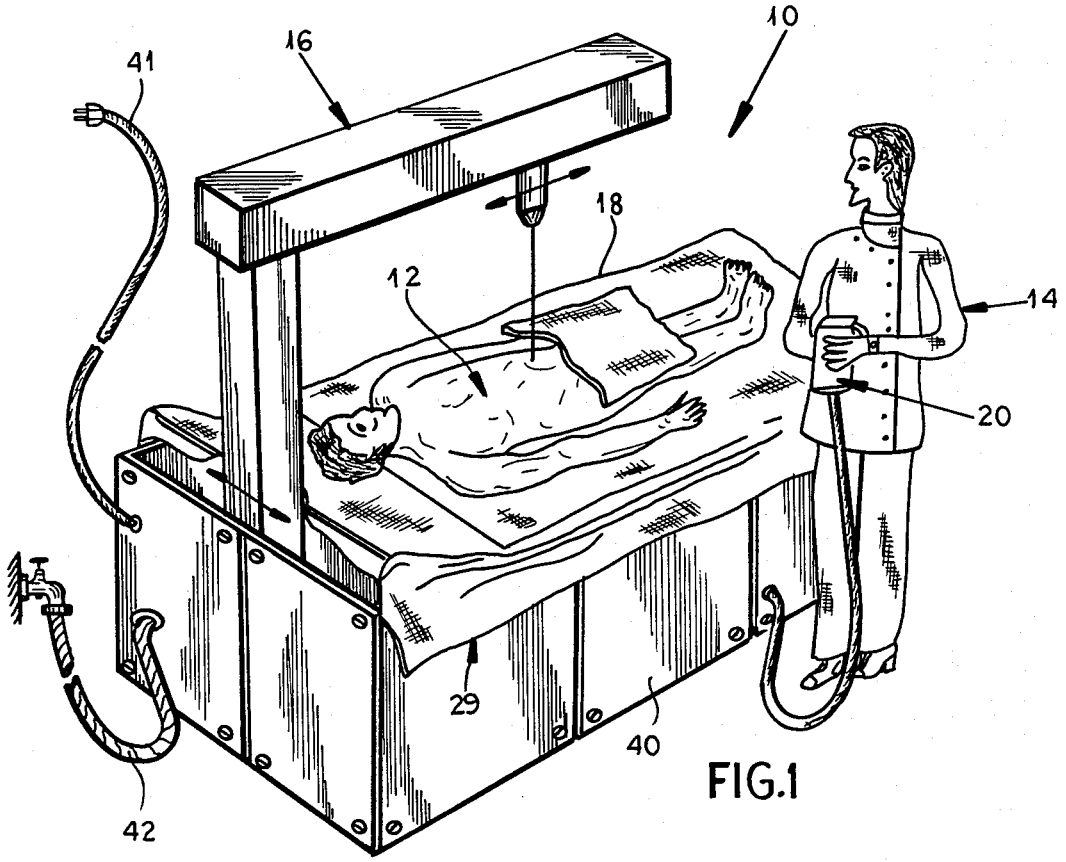
FIG. 1 is a perspective view of the apparatus of the present invention illustrating its use.
Figure 6:
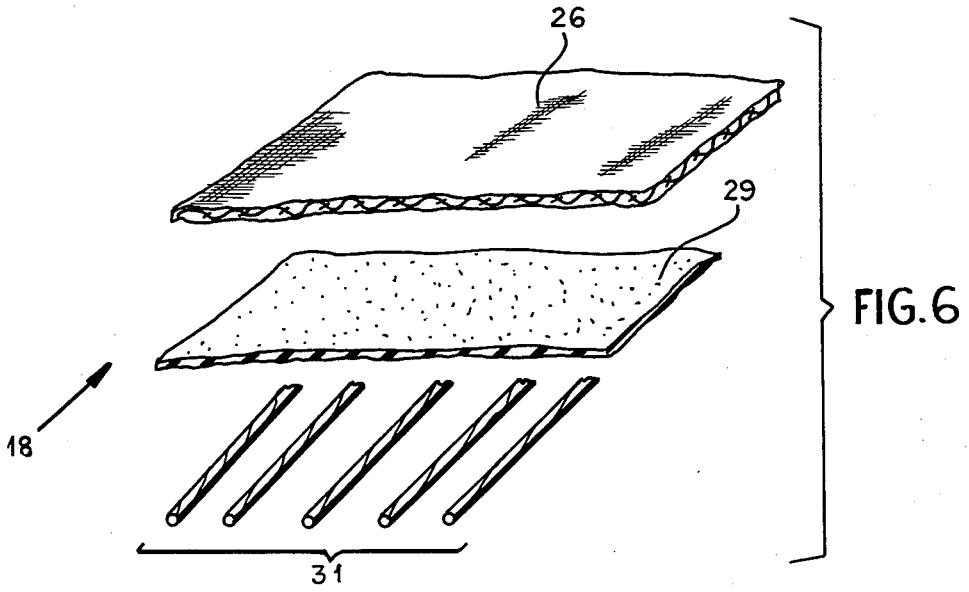
FIG. 6 is a perspective sectional view in exploded form illustrating the flexible layer and a grid support in addition to a cushion layering for use in the apparatus.

The apparatus 10 illustrated in FIG. 1 for the massaging of selected portions of the back of a patient 12, comprises a cabinet 40 which is formed with a grid 31 extending horizontally and better seen in FIG. 3 to carry the body of the patient, and a flexible layer 29 which is not permeable to water and overlies this grid so that it can be deformed upwardly by a jet of water from below.

The physiotherapist 14 is here shown to hold in his hands a control 20 connected by a cable to the housing 40 to effect control of the various parameters of the massage as will be described. The vessel within the housing 40, not visible in FIG. 1, can be filled with water by a hose 42 from a faucet and the electrical power can be supplied by a line cord 41.

The massage area 18 can also be covered With an additional flexible pad or cushion 26 to improve the patients comfort in repose.

The arm 16, cantilevered from an upright, extends over the patient at least in the massage area 18 and carries an indicator in the form of a light source having its axis coincide with the axis of the nozzle so that a spot of light is always projected onto the patient to indicate the location directly below the patient at which massage is being effected.

Utilizing the control 20, the physiotherapist can displace the nozzle and thus the light spot transversely and longitudinally as represented by the double-headed arrows in FIG. 1, e.g. in a Cartesian coordinate system. Normally, the water impermeable sheet or layer 29 is tucked in during use and the pad 26 can be an absorbent pad which can be sterilized or discarded after each use since this pad does come into contact with the body of the patient, although it is not contacted by the water which, therefore, remains uncontaminated.

In use, of course, the patient is placed upon the pad 26 and is locally massaged by the water jet under the control of the physiotherapist who, utilizing the control, can displace the nozzle to the selected portion of the body as indicated by the light spot.

Figure 2:
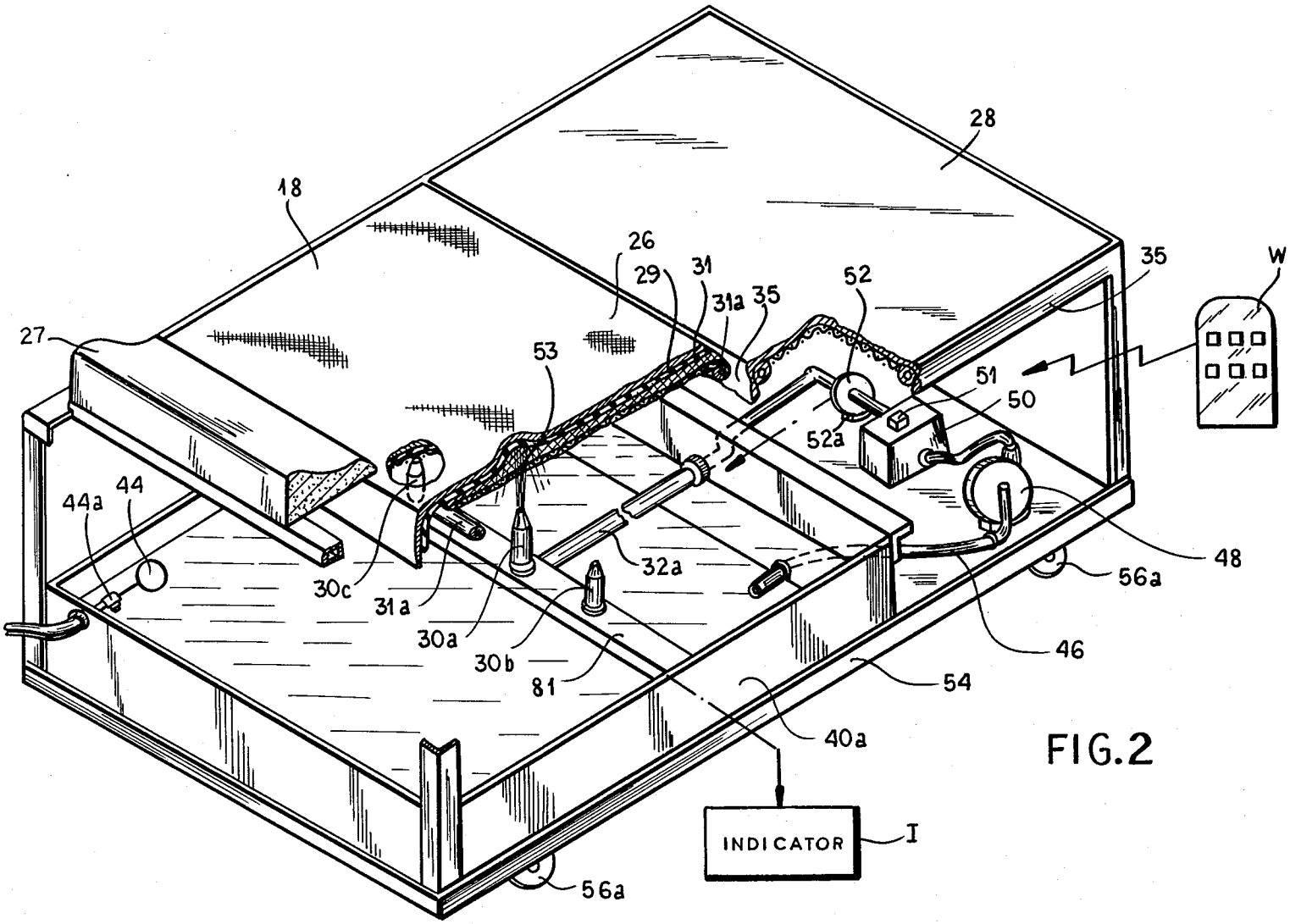
FIG. 2 is a perspective view, partly broken away, of the main structure of the apparatus.

From FIG. 2 it will be apparent that the apparatus comprises a frame 54 for the enclosure 40 and has a vessel **40*a* for a float 44 controlling a float valve 44*a* for establishing the level of the massaging water in this vessel. The grid 31, which can be a cable grid as shown or, if desired, a bar grid, is supported by transverse members 31*a* spanned upon bars 35 of the frame. The grid can be fastened to the bars 35 and 31*a***.

The diameters of the traverse cables of the grid 31 can be about 2 mm. Thus, about halfway through the treatment, the patient can be shifted by a distance in the range of the cable diameter longitudinally to ensure that the further treatment will also cover those portions of the body which previously rested against the cables.

Figure 3:
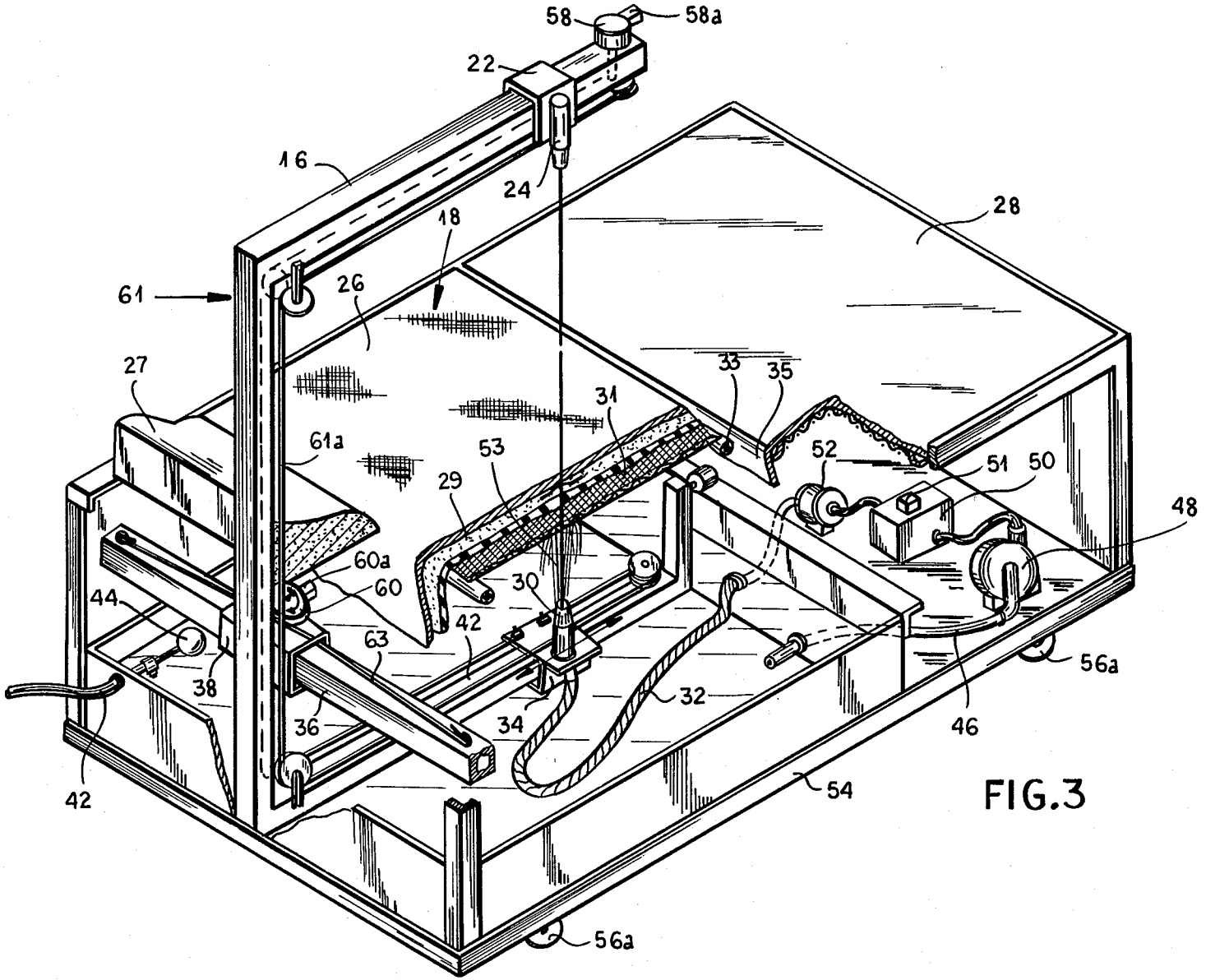
FIG. 3 is another perspective view, also partly broken away, showing the means for correlating the movements of the nozzle and the indicator.

Within the vessel **40*a*, a cross bar 81 carries 3 upwardly directed nozzles 30*a*, 30*b* and 30*c* (preferably a single nozzle as seen in FIG. 3) which are supplied with water by a flexible hose 32*a***.

The elasticity of the water-impermeable material 29 is such that it will become dimpled by the impingement of the upwardly directed water jets from the nozzles against the underside of the layer 29. The dimples press against the body at the selected regions to provide a single like massage.

A neck support 27 can be provided at one end of the apparatus to support the neck or head of the patient. A foot support area is also provided at 28.

A pump 48 draws water via a line 46 from the vessel **40*a* and forces that water through a heater 50 which can have a heat control 51 allowing setting of the temperature of the water of the jets, and then through a valve 52 to hose 32*a* from which the water is distributed to the nozzles. The valve 52 can have a bypass returning water to the vessel so that the setting of this valve can be used to cut off the feed to the nozzles while permitting recirculation through the heater to the vessel. The valve 52 may also have a control 52*a* operated by the controller 20 previously described or a wireless control shown only in dot dash lines in FIG. 2** at W for control of the parameters of the massage.

Wheels **56*a*** can be provided on the bottom of the apparatus to permit it to be moved about on the floor.

A means not shown in FIG. 2 can be provided for displacing the bar 81 and, if desired, the nozzles along the bar and can be coupled to an indicator as shown diagrammatically by the indicator I in FIG. 2.

This structure can be realized in practice, as can be seen from FIG. 3, by mounting the arm 16 on a carriage represented generally at 61. The carriage 61 is slidable on a cross bar 63 to effect transverse movement of the nozzle 30 which is connected by the hose 32 to the valve 52. The carriage 61 also includes a rail 42 whereby which a nozzle carrier 34 is slidable in the longitudinal direction of the apparatus. The carrier 34 is coupled with a carrier 22 for the light-beam projector 24 by a flexible element 61*a* passing over various pulleys.

A motor 60 on the guide 38 of the carriage displaces the carriage transversely so that both the light source and the nozzle 30 are moved in axial alignment laterally. A motor 58 drives the flexible element 61*a* to shift the light source and the nozzle synchronously in the longitudinal direction. The motors 58 and 60 may be provided with controls 58*a* and 60*a* respective to the controller 20 or wireless controller W to allow the aforementioned selective positioning of the nozzle beneath a portion of the body of the patient.

Figure 4:
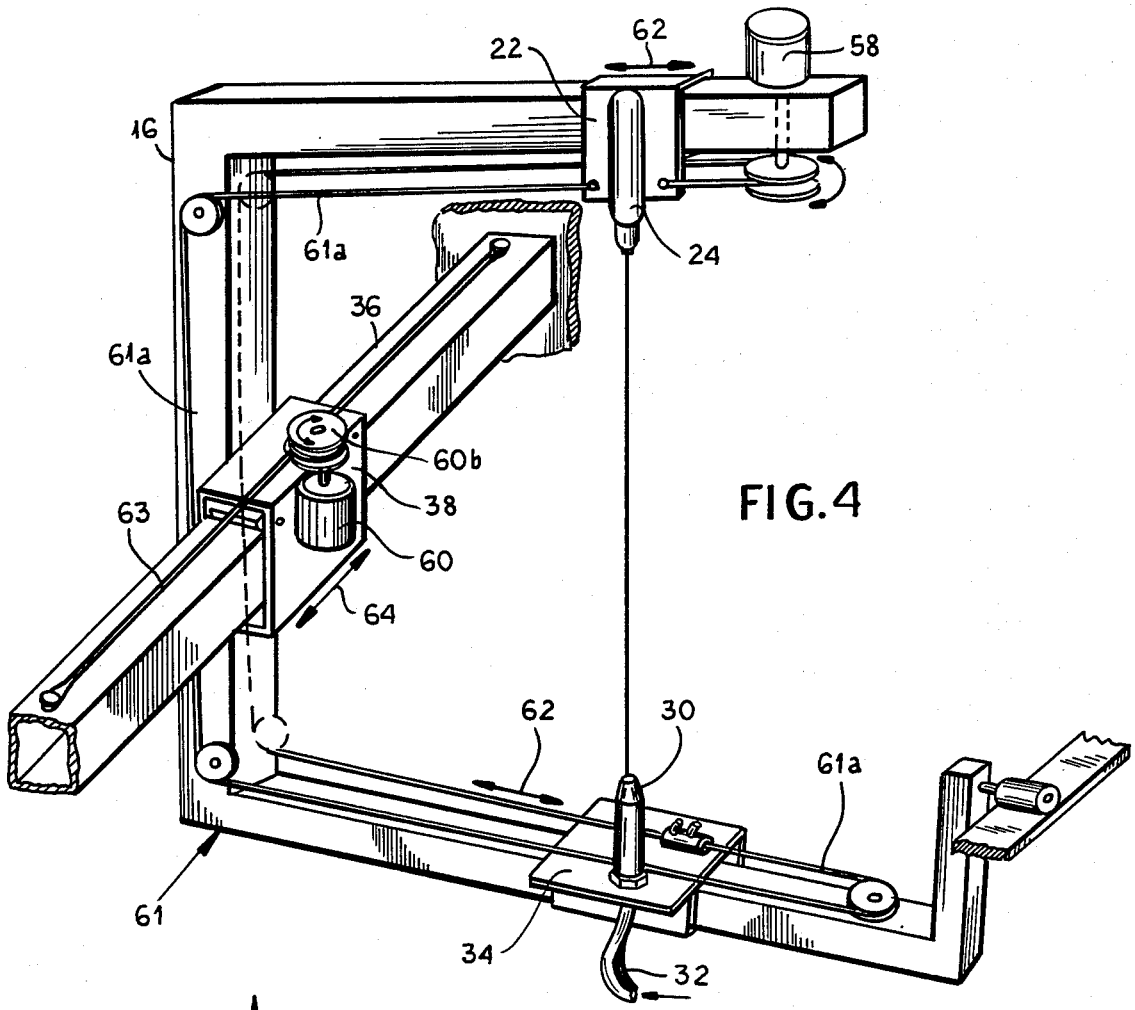
FIG. 4 is a detail perspective view of the latter means.
Figure 5:
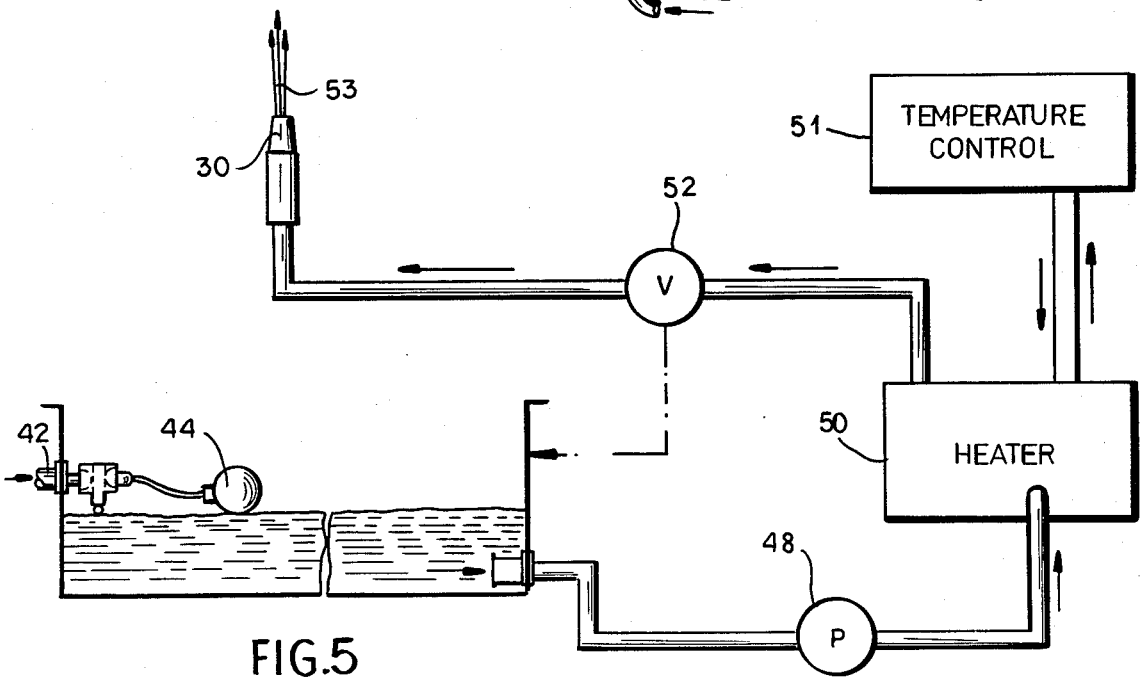
FIG. 5 is a diagram of a control system for use in this apparatus.

The motor structures have been shown in greater detail in FIG. 4 from which it is also apparent that the flexible element 63 passes around the pulley 60*b* and is anchored to the rail 36 to permit the guide 38 and the carriage 61 to be displaced transversely as represented by the arrow 64, e.g. along a Y axis. The motor 58 displaces the carriers 22 and 34 in the direction of arrows 62, i.e. in the longitudinal or X direction The jet 53 as shown in FIG. 5 has its pressure controlled by the valve 52 which may be remotely controlled as may the temperature control 51.

Figure 7:
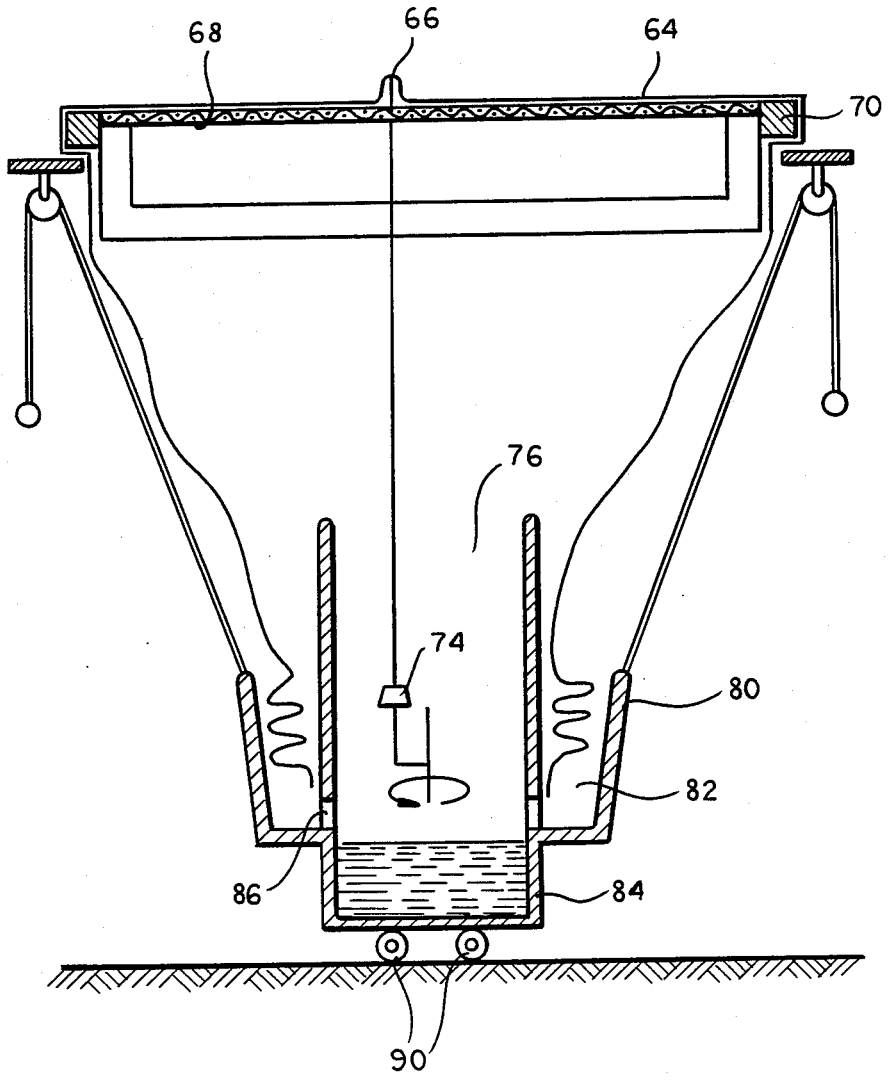
FIG. 7 is a cross sectional view of the device described generally in my above-identified copending application.

In FIG. 7 I have shown an apparatus of the type described in the earlier application and in which the flexible layer 64 forms part of a hood which is draped over the open work support 68 mounted on the frame 70. The hood may be a silicone rubber sheet and is gathered around the wall 86 of a vessel 84 around which a trough 80 is formed. Water collected in the trough 82 can pass through opening 86 into the vessel 84 which can be moved on rollers 90.

The nozzle 74 can be rotated and tilted and the angular displacement of the nozzle represents an additional, polar, coordinate system for displacing the nozzle and jet below the patient. The other coordinate system is a Cartesian coordinate system as described whereby the nozzle and jet are shifted in x and y directions.

The apparatus is more fully described in my above mentioned copending application which is hereby incorporated by reference. Of course, this apparatus operates under exactly the same principles and may make use of an indicator coupled to the nozzle as described above.

I claim:

1. An apparatus for massaging a selected portion of the body of an individual, comprising:

an upwardly open water-collection vessel;

an openwork support spaced above said water-collection vessel;

a water-impermeable flexible layer overlying said openwork support and deformable upwardly therefrom, said flexible layer having an upper surface upon which the body of an individual to be massaged can repose with a selected portion of the body of the individual resting against said surface;

at least one nozzle located beneath said layer and training at least one water jet upwardly against an underside of said layer so that the water jet deforms said layer and massages said individual;

an indicator operatively coupled with said nozzle and displaying the portion of said body directly overlying the portion of said layer against which said jet is trained; and means for displacing said nozzle below layer in accordance with the display afforded by said indicator so that said jet effects massage of said selected portion of the body through said layer and water used in said massage collects in said vessel, said means for displacing including:

a carriage on which said nozzle is mounted, an upright connected to said carriage, a cantilever arm connected to and overhanging said layer and carrying said indicator, said nozzle being displaceable along said carriage and said indicator being displaceable along said arm, a flexible element on said carriage, said upright and said arm for interconnecting said indicator and said nozzle for joint movement, pulleys on said carriage, said upright and said arm for defining two passes of said flexible element respectively connected to said indicator and said nozzle for moving same in the same direction, a motor coupled to said flexible element for displacing same, and another motor operatively connected to said carriage for displacing same transversely to said upright and said arm.

2. The apparatus defined in claim 1 wherein said support is a flexible cable grid.

3. The apparatus defined in claim 1, further comprising pump means connecting said nozzle with said vessel for recirculating said water from said vessel to said nozzle.

4. The apparatus defined in claim 3, further comprising means for controlling the temperature of the water forming said jet.

5. The apparatus defined in claim 3, further comprising means for controlling the kinetic energy of the jet impinging upon said layer.

6. The apparatus defined in claim 1 wherein said indicator is located above said layer and is mechanically coupled with said nozzle for movement therewith.

7. The apparatus defined in claim 1 wherein said indicator is a light source projecting a light spot on the body of the individual.

* * * * *